US011795677B2

(12) United States Patent
Morita et al.

(10) Patent No.: US 11,795,677 B2
(45) Date of Patent: Oct. 24, 2023

(54) FLUSH TOILET

(71) Applicant: TOTO LTD., Kitakyushu (JP)

(72) Inventors: Tomoaki Morita, Fukuoka (JP); Takehiro Minami, Fukuoka (JP); Keita Yoshisaka, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 200 days.

(21) Appl. No.: 17/407,221

(22) Filed: Aug. 20, 2021

(65) Prior Publication Data

US 2022/0064931 A1 Mar. 3, 2022

(30) Foreign Application Priority Data

Aug. 31, 2020 (JP) ..... 2020-146383

(51) Int. Cl.
*E03D 11/18* (2006.01)

(52) U.S. Cl.
CPC ..... *E03D 11/18* (2013.01); *E03D 2201/30* (2013.01)

(58) Field of Classification Search
CPC .. E03D 11/18; E03D 2201/20; E03D 2201/30
See application file for complete search history.

(56) References Cited

U.S. PATENT DOCUMENTS 5,918,325 A * 7/1999 Arita ..... E03D 11/02 4/420
8,032,956 B2 * 10/2011 Prokopenko ..... E03D 11/08 4/425
10,323,400 B2 * 6/2019 Hashimoto ..... E03D 11/08
10,358,810 B2 * 7/2019 Saito ..... E03D 11/16
2012/0284911 A1 * 11/2012 Kamiya ..... E03D 11/18 4/420

FOREIGN PATENT DOCUMENTS

| | | | |
|---|---|---|---|
| JP | 62-21180 | 2/1987 | |
| JP | 5-44242 | 2/1993 | |
| JP | 10-331239 | 12/1998 | |
| JP | 2003-206562 | 7/2003 | |
| JP | 2013-19169 | 1/2013 | |
| KR | 200395847 | * 6/2005 | ..... E03D 11/18 |

OTHER PUBLICATIONS

Japanese Office Action for Japanese Patent Application No. 2020-146383 dated Aug. 30, 2022.

* cited by examiner

*Primary Examiner* — David P Angwin
*Assistant Examiner* — Nicholas A Ros
(74) *Attorney, Agent, or Firm* — AMIN, TUROCY & WATSON, LLP

(57) ABSTRACT

A flush toilet includes a bowl part that receives waste, a drainage water trap that is connected to a bottom of the bowl part, a jet water spout port that spouts washing water toward the drainage water trap, and a discharge port that is connected to the drainage water trap and discharges waste, wherein the drainage water trap includes a rising pipe line that is connected to the bowl part, a curved pipe line that includes a rising curved part that is connected to the rising pipe line and rises backward and a falling curved part that falls backward, a falling pipe line that is connected to the curved pipe line, and a swelled part that forms a space that is swelled toward a back side thereof and is continuous with the discharge port, on a downstream side of a curved top part of the curved pipe line.

6 Claims, 6 Drawing Sheets

FLUSH TOILET

CROSS-REFERENCE TO RELATED APPLICATION(S)

The present application claims the benefit of priority to Japanese Patent Application No. 2020-146383 filed on Aug. 31, 2020, the entire contents of which Japanese Patent Application are incorporated by reference in the present application.

FIELD

A disclosed embodiment(s) relate(s) to a flush toilet.

BACKGROUND

For a flush toilet, a so-called blowout type has conventionally been provided that includes a drainage water trap that has a rising pipe line, a curved pipe line, and a falling pipe line where a washing water with a powerful water force is spouted from a jet water spout port toward the drainage water trap so as to generate a powerful water flow, so that a waste is blown out to a downstream side thereof without relying on a siphon action (see, for example, Japanese Patent Application Publication No. 2003-206562).

Furthermore, a flush toilet has been provided where an internal space of a curved part on a downstream side thereof is increased in order to facilitate a waste to transfer to a back side (a downstream side) thereof in a drainage water trap (see, for example, Japanese Patent Application Publication No. H10-331239).

However, in a case of a blowout-type flush toilet in a conventional flush toilet as described above, a washing water flows through a rising pipe line without being diffused while maintaining a thin flowing stream thereof by a jet water spout, so that a washing water may collide with a top inner peripheral surface of a curved pipe line near a top part of a drainage water trap so as to cause a part of a washing water to flow backward. Hence, a washing water that flows backward in a rising pipe line may provide a resistance thereof so as to degrade a water drainage performance.

Furthermore, although it is also considered that an internal space of a curved part of a drainage water trap on a downstream side thereof is increased so as to enhance water drainage power of a washing water, merely increasing an internal space of a drainage water trap may cause a washing water to collide with and stay in an increased space so as to rather degrade a water drainage performance.

SUMMARY

A flush toilet according to an aspect of an embodiment is a flush toilet that washes a toilet body with a washing water, wherein the toilet body includes a bowl part that receives a waste, a drainage water trap that is connected to a bottom of the bowl part, a jet water spout port that spouts a washing water from a front side of the drainage water trap toward the drainage water trap, and a discharge port that is connected to the drainage water trap and discharges a waste from the toilet body, wherein the drainage water trap includes a rising pipe line that is connected to the bowl part, a curved pipe line that has a rising curved part that is connected to the rising pipe line and rises toward a back side thereof and a falling curved part that falls from the rising curved part toward a back side thereof, and a falling pipe line that is connected to the curved pipe line, wherein the drainage water trap has a swelled part that forms a space that is swelled toward a back side thereof and is continuous with the discharge port, on a downstream side of a curved top part of the curved pipe line.

BRIEF DESCRIPTION OF DRAWING(S)

DESCRIPTION OF EMBODIMENT(S)

Hereinafter, an embodiment(s) of a flush toilet as disclosed in the present application will be explained in detail with reference to the accompanying drawing(s). Additionally, this invention is not limited by an embodiment(s) as illustrated below.

Flush Toilet

Figure 1:
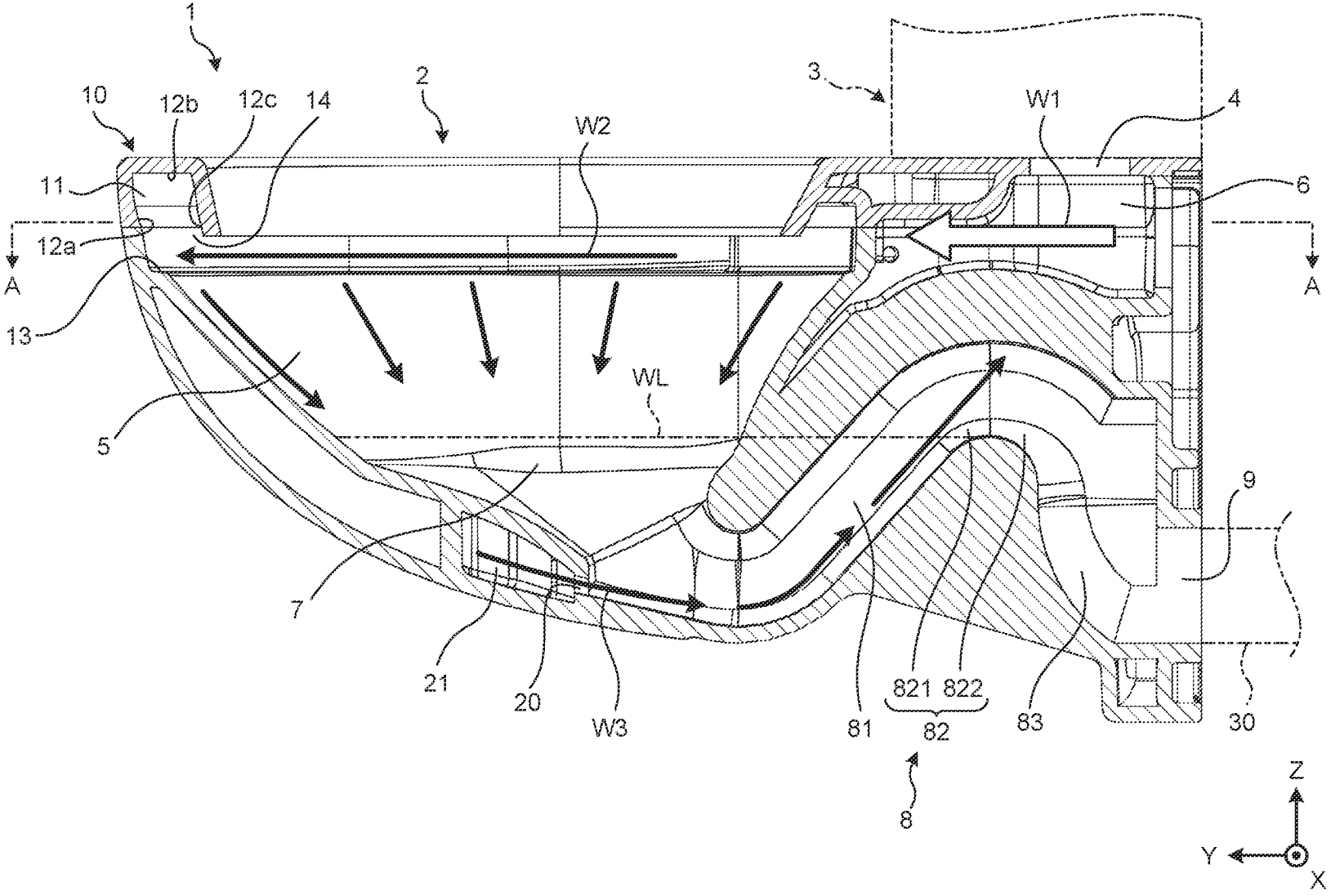
FIG. 1 is a side cross-sectional view that illustrates a flush toilet according to an embodiment.
Figure 2:
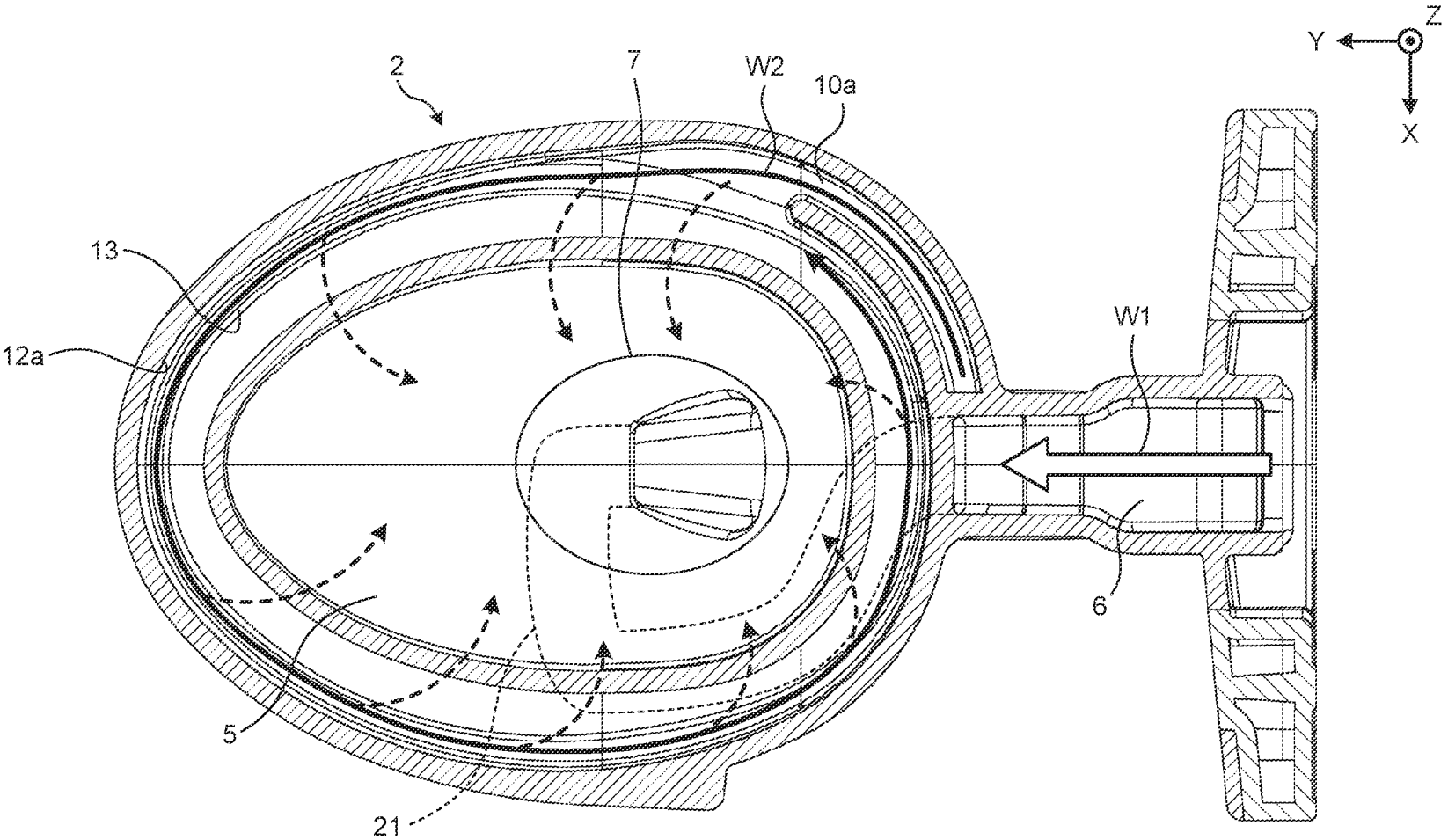
FIG. 2 is a cross-sectional view along line A-A in FIG. 1.

An overall configuration of a flush toilet 1 according to an embodiment will be explained with reference to FIG. 1 and FIG. 2. FIG. 1 is a side cross-sectional view that illustrates the flush toilet 1 according to an embodiment. FIG. 2 is a cross-sectional view along line A-A in FIG. 1.

As illustrated in FIG. 1 and FIG. 2, the flush toilet 1 includes a toilet body 2. The toilet body 2 is made of, for example, a ceramic(s). Additionally, the toilet body 2 may be made of a resin(s) or may be manufactured by combining a ceramic(s) and a resin(s). The toilet body 2 is a so-called wall-hung type that is mounted on a wall surface of a toilet room. A water supply device such as a water storage tank 3 that is a washing water source is installed above a back side of the toilet body 2.

The water storage tank 3 is connected to a water supply source (non-illustrated) such as a waterworks. As a washing operation is started by operating an operation lever (non-illustrated) that is provided on the water storage tank 3, a water drainage valve (non-illustrated) of the water storage tank 3 is opened, so that a predetermined amount (for example, 6 L) of a washing water is supplied from the water storage tank 3 to a supply port 4 that is opened on a top of the toilet body 2 on a center and back side thereof. Additionally, the supply port 4 is not only formed at a center thereof but may also be formed so as to shift from a frontward or backward center line to a right side or a left side thereof.

Furthermore, for the flush toilet 1, it is possible to use, for example, a water-saving type flush toilet where an amount of a washing water that is supplied from the water storage tank 3 is within a range of 3 L to 6 L, preferably, a water-saving type flush toilet where it is within a range of 4.8 L to 6 L.

Furthermore, a water supply device such as the water storage tank 3 may be another water supply device such as a flush valve that is capable of supplying a specified amount of a washing water as well as such a water storage tank 3.

Furthermore, a bowl part 5 is formed on a top of the toilet body 2 on a front side thereof and a water guide path 6 that is formed between the supply port 4 that is connected to an end part of the water storage tank 3 on a downstream side thereof and a rim water passing path 11 as described later and guides a washing water that is supplied from the water storage tank 3 from the supply port 4 to the rim water passing path 11 is formed on a top of the toilet body 2 on a back side thereof. Additionally, a flow path of a part of the water guide path 6 and the rim water passing path 11 may be formed of another structure such as a distributor.

Furthermore, a bottom of the bowl part 5 is provided as a water pooling part 7 and a predetermined amount of a pooled water where a pooled water surface thereof at an initial water level is denoted by WL is stored therein. Furthermore, a lower end part of the water pooling part 7 is connected to an inlet of a drainage water trap 8 and the drainage water trap 8 extends backward from such an inlet.

Furthermore, the bowl part 5 is formed into a bowl shape and includes a rim part 10 that forms the rim water passing path 11 that guides a washing water on an upper edge part of a bowl surface that receives a waste.

The water guide path 6 extends forward from the supply port 4 and is connected to the rim water passing path 11. The water guide path 6 extends from a vicinity of the supply port 4 that is arranged at a substantially center of the toilet body 2 toward the bowl part 5.

On the water guide path 6, a washing water W1 is regulated well so as to improve a directionality of a washing water W1 and a washing water W1 is spouted so as to provide a flow that is regulated in a direction that circulates from the water guide path 6 to the rim water passing path 11 and a flow in a state of a comparatively powerful water force.

Furthermore, the water guide path 6 is formed in such a manner that a part thereof is parallel to a part of a joining part of the rim water passing path 11. In a vicinity of an outlet (a water spout port) 10*a* of the water guide path 6, it substantially coincides with a direction of a flow of a washing water W2 that is circulated through the rim water passing path 11, so that it is possible for a washing water W1 that flows out of the water spout port 10*a* of the water guide path 6 to form a flow that flows through the rim water passing path 11 toward a substantially identical turning direction (a circulating direction) and is circulated through the rim water passing path 11 in a state where a water force thereof is maintained (a state where a flow volume and a flow rate thereof are substantially maintained).

Thereby, it is possible to prevent or reduce flowing of a washing water W1 from the water guide path 6 that joins to the rim water passing path 11 in a direction that is opposite to that of a main flow (a washing water W2) through the rim water passing path 11 and/or flowing down of a main flow (a washing water W2) from a slit opening part 14 as described later to a bowl surface.

The rim part 10 is formed into a ring shape over a whole circumference of the bowl part 5 as an upper edge part thereof. The rim part includes a rim outer wall part 12*a*, a rim upper wall part 12*b*, and a rim inner wall part 12*c*. The rim outer wall part 12*a* forms an outer peripheral surface of the rim part 10 and is formed into a standing wall shape so as to rise to a top part thereof on an outer surface of the toilet body 2. The rim upper wall part 12*b* forms a flat surface on a top of the rim part 10. The rim inner wall part 12*c* forms an inner peripheral surface of the rim part 10 and extends so as to droop from the rim upper wall part 12*b* slightly inward and downward.

A shelf part 13 is formed on a bottom of the rim part 10. The shelf part 13 is formed as a substantially flat surface that extends outward from an upper edge part of a bowl surface of the bowl part 5 in the rim part 10 and is formed into a ring shape over a substantially whole circumference of the bowl part 5.

A slit opening part 14 is formed between the rim part 10 and a bowl surface of the bowl part 5. The slit opening part 14 is opened downward so as to form a water spout part of the rim part 10 toward a bowl surface, below the rim water passing path 11, together with the rim inner wall part 12*c*.

The drainage water trap 8 that extends on a back of the toilet body 2 includes a rising pipe line 81, a curved pipe line 82, and a falling pipe line 83. An end part of the rising pipe line 81 on an upstream side thereof is connected to the bowl part 5 (the water pooling part 7). The rising pipe line 81 is a pipe line that is inclined so as to rise toward a back side thereof.

An end part of the curved pipe line 82 on an upstream side thereof is connected to an end part of the rising pipe line 81 on a downstream side thereof. The curved pipe line 82 has a rising curved part 821 and a falling curved part 822. The rising curved part 821 is a site that is continuous with the rising pipe line 81 and is inclined so as to rise toward a back side thereof. The falling curved part 822 is a site that is continuous with the rising curved part 821 and is inclined so as to fall toward a back side thereof. A connection part of the rising curved part 821 and the falling curved part 822 is provided as a curved top part that is a highest site of the curved pipe line 82.

The falling pipe line 83 is connected to an end part of the curved pipe line 82 on a downstream side thereof, that is, an end part of the falling curved part 822 on a downstream side thereof. The falling pipe line 83 is a pipe line that is inclined so as to fall toward a back side thereof. Furthermore, an end part of the falling pipe line 83 on a downstream side thereof is connected to a discharge port 9 that discharges a washing water and/or a waste from the toilet body 2. The discharge port 9 is connected to an equipped pipe 30 that is a pipe outside the flush toilet 1.

A jet water spout port 20 that spouts a washing water toward the drainage water trap 8 (the rising pipe line 81) is formed on a front side of the rising pipe line 81 of the drainage water trap 8. As illustrated in FIG. 2, the jet water spout port 20 is formed at an outlet of a jet water guide path 21 and spouts a washing water in the jet water guide path 21 with a powerful water force so as to cause a siphon action.

Herein, a washing water that is spouted from the jet water spout port 20 flows through the rising pipe line 81 without being diffused while maintaining a thin flowing stream thereof, so that it may collide with a top inner peripheral surface near a curved top part of the drainage water trap 8 so as to cause a part of a washing water to flow backward. Thus, as a washing water flows backward, a washing water that flows backward may provide a resistance thereof so as to degrade a water drainage performance. Hence, in the present embodiment, the drainage water trap 8 is provided with a structure that is capable of preventing or reducing a backward flow of a washing water so as to prevent or reduce degradation of a water drainage performance.

Drainage Water Trap

Figure 3:
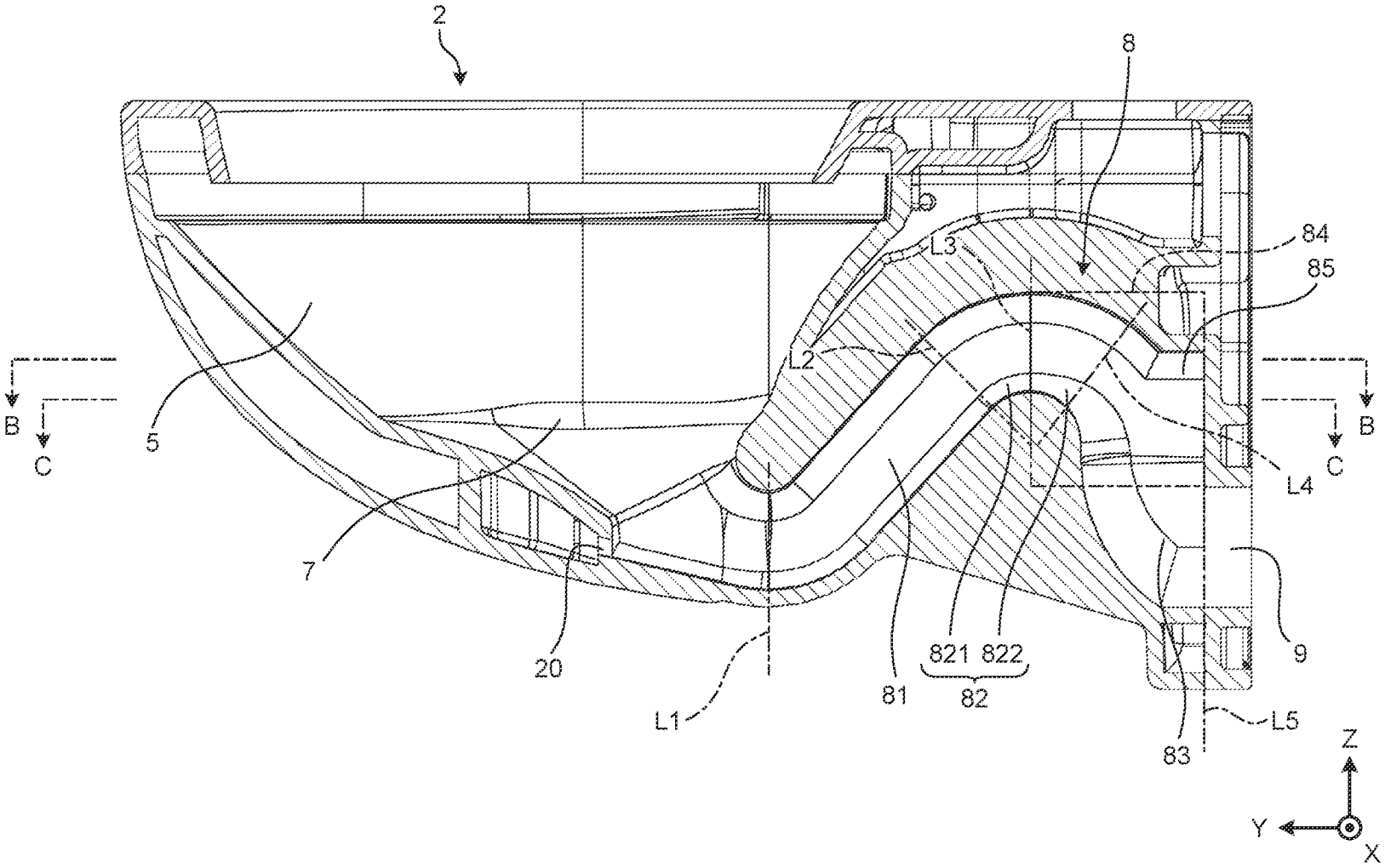
FIG. 3 is a side cross-sectional view that illustrates a swelled part and a protrusion part of a drainage water trap.
Figure 4A:
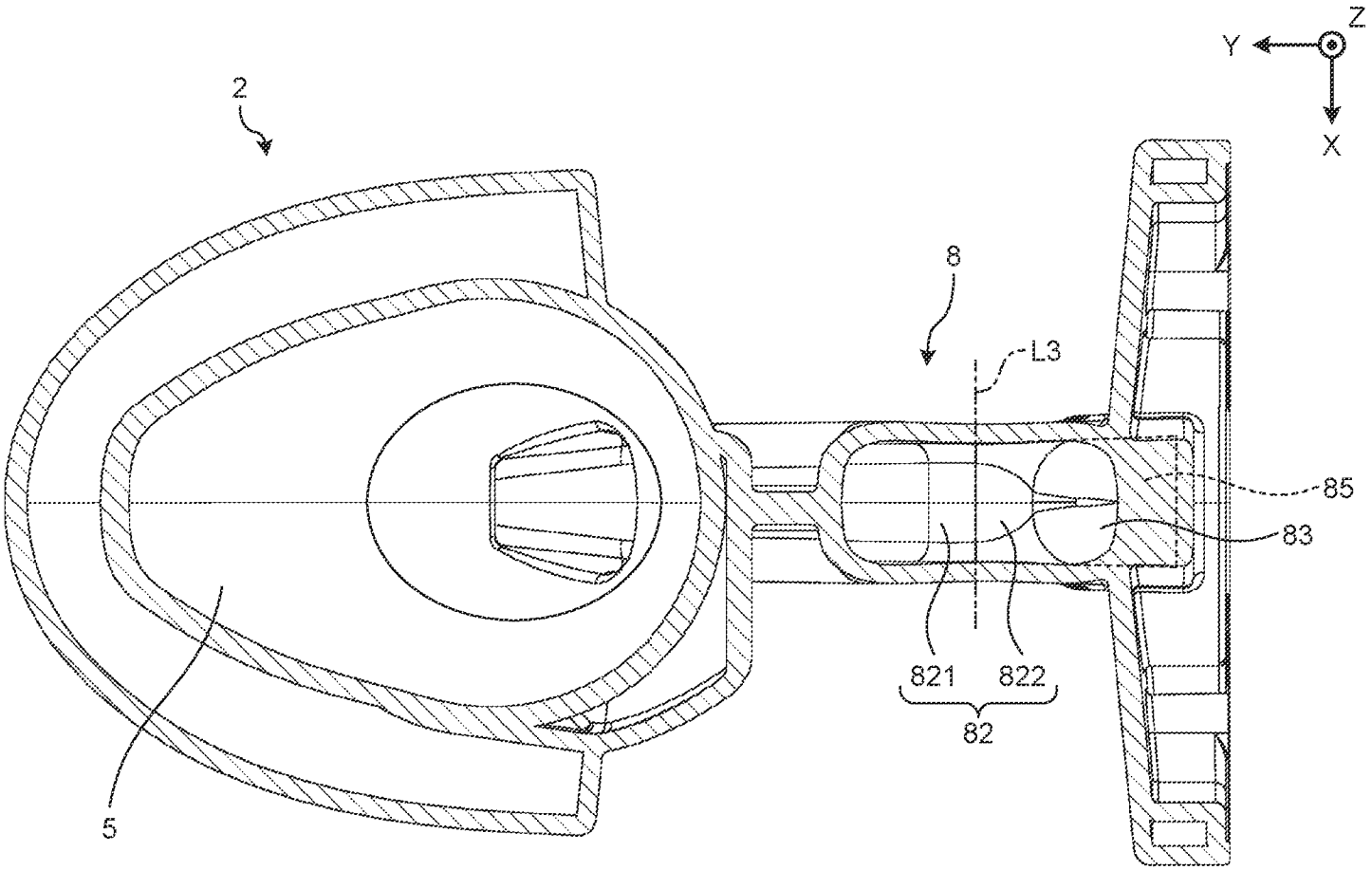
FIG. 4A is a cross-sectional view along line B-B in FIG. 3.
Figure 4B:
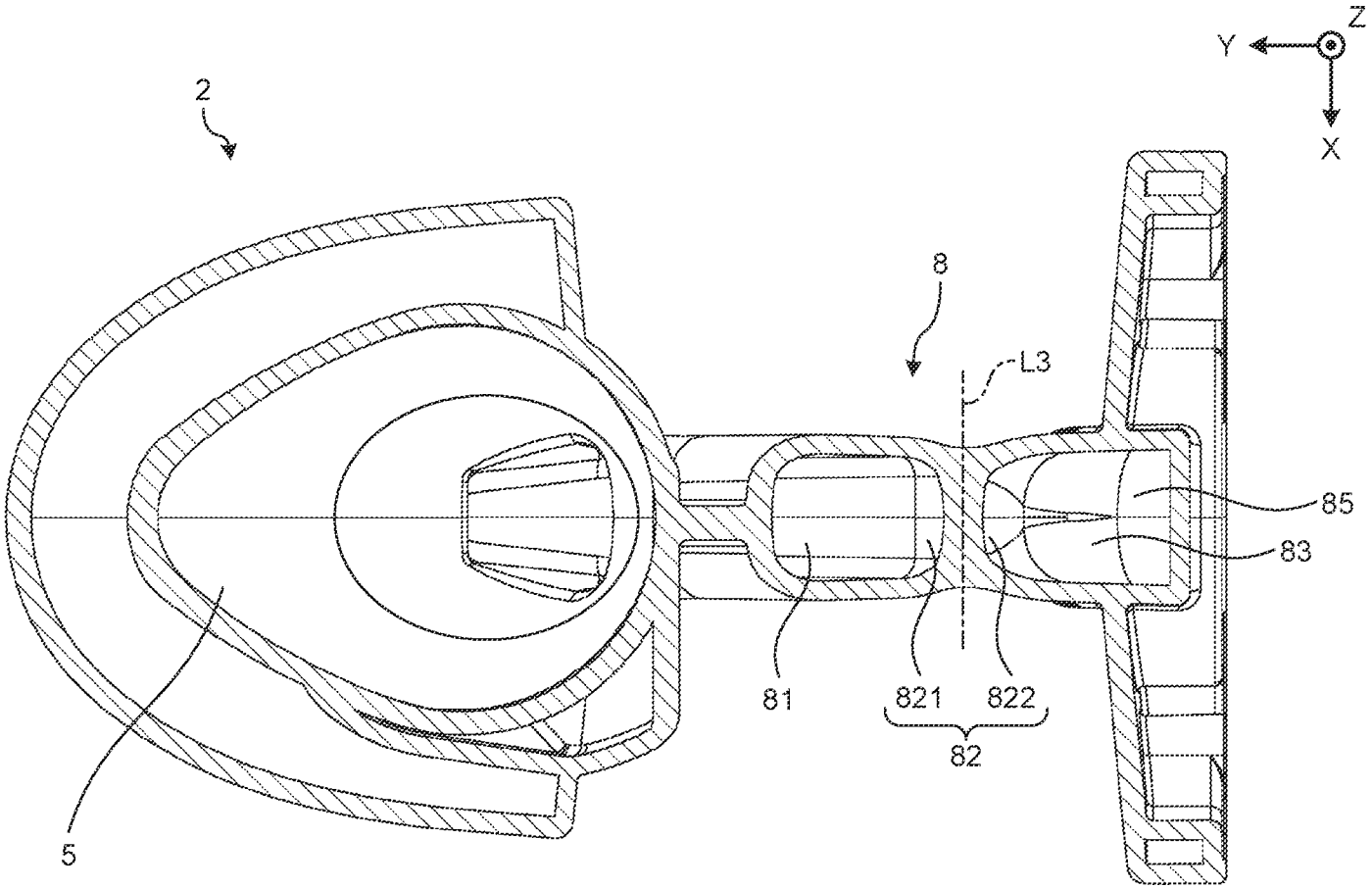
FIG. 4B is a cross-sectional view along line C-C in FIG. 3.
Figure 5A:
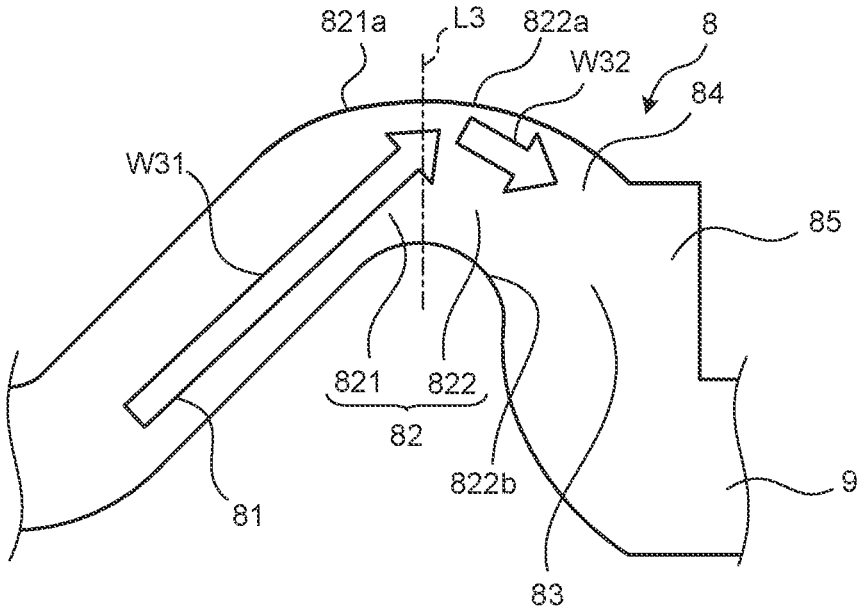
FIG. 5A is an explanatory diagram of a flow of a washing water in a present example.
Figure 5B:
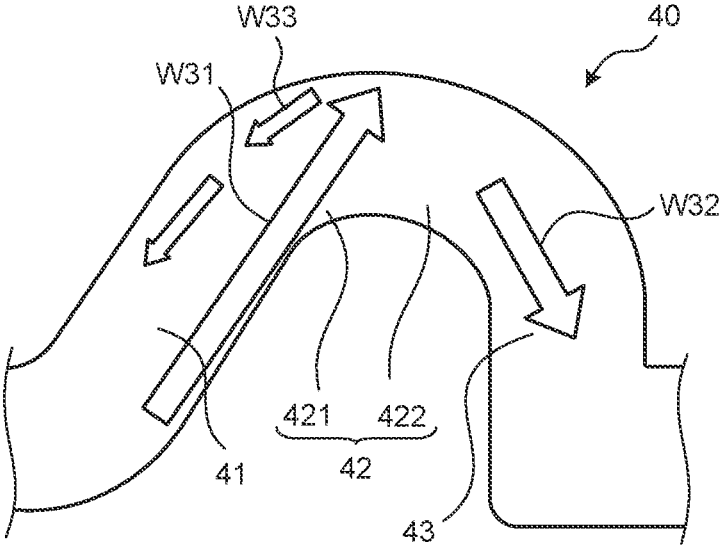
FIG. 5B is an explanatory diagram of a flow of a washing water in a comparative example.

Hereinafter, a structure of a drainage water trap 8 will be explained in detail with reference to FIG. 3 to FIG. 5B. FIG. 3 is a side cross-sectional view that illustrates a swelled part 84 and a protrusion part 85 of the drainage water trap 8. FIG. 4A is a cross-sectional view along line B-B in FIG. 3. FIG. 4B is a cross-sectional view along line C-C in FIG. 3. FIG. 5A is an explanatory diagram of flows of washing waters W31, W32 in a present example. FIG. 5B is an explanatory diagram of flows of washing waters W31, W32, W33 in a comparative example.

As illustrated in FIG. 3 and described above, the drainage water trap 8 includes a rising pipe line 81, a curved pipe line 82, and a falling pipe line 83. Furthermore, the curved pipe line 82 has a rising curved part 821 and a falling curved part 822. A connection part of the rising curved part 821 and the falling curved part 822 is provided as a curbed top part of such a curved pipe line 82.

That is, as illustrated in FIG. 3, the rising pipe line 81 is a pipe line from a reference line L1 to a reference line L2, the curved pipe line 82 is a pipe line from the reference line L2 to a reference line L4, and the falling pipe line 83 is a pipe line from the reference line L4 to a reference line L5. Furthermore, in the curved pipe line 82, the rising curved part 821 is a site from the reference line L2 to a reference line L3, and the falling curved part 822 is a site from the reference line L3 to the reference line L4. Furthermore, a curved top part of the curved pipe line 82 is provided at a position of the reference line L3.

Furthermore, the drainage water trap 8 includes a swelled part 84 and a protrusion part 85. The swelled part 84 is a site that forms a space that is swelled toward a back side thereof, on a downstream side of a curved top part of the curved pipe line 82. Furthermore, the swelled part 84 is continuous with a discharge port 9 so as not to disturb a flow of a washing water from a curved top part, on a downstream side of a curved top part of the curved pipe line 82. Herein, "continuous" refers to, for example, a shape that does not generate a flow of a washing water in a direction that is opposite to that of a flow toward the discharge port 9, such as a protrusion part that disturbs a flow of a washing water being absent in front of the discharge port 9.

The protrusion part 85 is a site that protrudes backward so as to be continuous with the falling curved part 822. The protrusion part 85 is also continuous with the discharge port 9 so as not to disturb a flow of a washing water. Such a protrusion part 85 is included in the swelled part 84.

Furthermore, the protrusion part 85 protrudes so as to extend from a top inner peripheral surface of the falling curved part 822 toward a back side thereof in a horizontal direction. Additionally, for the drainage water trap 8, a cross-sectional shape thereof is a substantially circular shape. Hence, an inner surface of an upper half part of the drainage water trap 8 (the rising pipe line 81, the curved pipe line 82 (the rising curved part 821 and the falling curved part 822), and the falling pipe line 83) is referred to as an top inner peripheral surface (that is also referred to as a top surface) and an inner surface of a lower half part thereof is referred to as a bottom inner peripheral surface (that is also referred to as a lower surface).

Furthermore, as illustrated in FIG. 4A and FIG. 4B, the protrusion part 85 is formed on only a back side of the falling pipe line 83. In other words, the protrusion part 85 protrudes toward only a back of the falling pipe line 83 and does not protrude toward a side of the falling pipe line 83. Additionally, FIG. 4A and FIG. 4B also illustrate a reference line (the reference line L3) that divides respective pipe lines 81, 82, 83.

Furthermore, as illustrated in FIG. 4B, a width of a side of the protrusion part 85, that is, a width thereof in leftward and rightward directions, is substantially identical to a width of side of the rising curved part 821 of the curved pipe line 82 (in leftward and rightward directions).

In the present embodiment, the curved pipe line 82 is a pipe line with a mountain shape in a side view that is composed of the rising curved part 821 and the falling curved part 822. Then, as illustrated in FIG. 5A, a curvature of a top inner peripheral surface 822*a* of the falling curved part 822 is less than a curvature of a top inner peripheral surface 821*a* of the rising curved part 821 in a side view. That is, the top inner peripheral surface 822*a* of the falling curved part 822 is provided as a curve that is gentler than that of the top inner peripheral surface 821*a* of the rising curved part 821.

Furthermore, a distance between an upper end part of the top inner peripheral surface 822*a* and a lower end part of a bottom inner peripheral surface 822*b* of the falling curved part 822 on a cross section of a flow path thereof is increased toward a downstream side thereof in a side view. That is, for the falling curved part 822, a pipe diameter thereof is increased toward a downstream side thereof.

Mode of Flow of Washing Water in Drainage Water Trap

Herein, modes of flows of washing waters W31, W32, W33 in a drainage water trap 8 will be explained with reference to FIG. 5A and FIG. 5B. Additionally, FIG. 5A illustrates modes of flows of washing waters W31, W32 in a present example (the drainage water trap 8) and FIG. 5B illustrates modes of flows of washing waters W31, W32, W33 in a comparative example (a conventional drainage water trap 40).

As illustrated in FIG. 5A, in the drainage water trap 8 in the present example, as a washing water 31 with a powerful water force that flows through a rising pipe line 81 by a jet water spout port 20 (see FIG. 3) reaches a downstream side of a curved top part (a site at a reference line L3) of a curved pipe line 82, it flows into a swelled part 84. Hence, a washing water W32 that flows into the swelled part 84 flows to a discharge port 9 without disturbing a flow thereof in a middle thereof. In such a case, a protrusion part 85 is formed, so that a washing water W32 that flows into the swelled part 84 is guided to the discharge port 9 immediately and does not stay in the swelled part 84.

As illustrated in FIG. 5B, in a drainage water trap 40 in the comparative example, as a washing water W31 with a powerful water force that flows through a rising pipe line 41 reaches a downstream side of a curved top part (a site at a reference line L3) of a curved pipe line 42, a washing water W32 flows through a falling pipe line 43 but it collides with a top inner peripheral surface of a falling curved part 422 so as to generate a component (a washing water W33) that returns to a rising curved part 421. Thus, in the drainage water trap 40 in the comparative example, a flow of a washing water W31 is disturbed by a washing water W33 that flows backward.

In the drainage water trap 8 in the present example, a backward flow of a washing water W31 in the drainage water trap 40 in the comparative example is absent, so that a flow of a washing water W31 is not disturbed.

Thus, in a flush toilet 1 according to an embodiment, a space that is swelled toward a back side thereof is formed in a drainage water trap 8, so that, when a washing water W3 that is spouted from a jet water spout port 20 reaches a downstream side of a curved top part of the drainage water trap 8, a reaching washing water W3 flows into a swelled part 84, that is, a space that is swelled toward a back side thereof. Thereby, it is possible to prevent or reduce a backward flow of a washing water W3 in a curved part (a curved pipe line 82) of the drainage water trap 8. Furthermore, a backward flow of a washing water W3 is thus prevented or reduced, so that it is possible to prevent or reduce degradation of a discharge performance.

Furthermore, a curved pipe line 82 to a discharge port 9 are continuous, so that a washing water W32 that flows into the swelled part 84 is guided to the discharge port 9 immediately and a washing water W32 does not stay in the swelled part 84. Thus, a washing water W32 does not stay in the swelled part 84, so that it is possible to further prevent or reduce degradation of a discharge performance.

Furthermore, a protrusion part 85 protrudes so as to extend from the curved pipe line 82 in a horizontal direction, so that it is possible to separate a washing water W32 that flows along a top inner peripheral surface 822*a* of a falling curved part 822 at a positon in the drainage water trap 8 where changing from the top inner peripheral surface 822*a* of the falling curved part 822 to the protrusion part 85 is caused, from the top inner peripheral surface 822*a*, and transfer it to a space of the protrusion part 85.

Furthermore, the protrusion part 85 is formed on only a back side of a falling pipe line 83, in other words, the protrusion part 85 is formed on only a back part of the falling pipe line 83, so that a vector of a backward flow is increased and it is possible to enhance a flow of a washing water W32 toward the discharge port 9.

Furthermore, a width of a side of the protrusion part 85 is substantially identical to a width of a side of a rising curved part 821, so that it is possible to cause a washing water W31 that flows through the rising curved part 821 to flow into the protrusion part 85 without causing a pressure loss.

Furthermore, the top inner peripheral surface 822*a* of the falling curved part 822 where a washing water W31 that reaches a downstream side of a curved top part of the drainage water trap 8 collides therewith is a gentle curve in a side view thereof, so that a washing water W31 is readily guided to a back side thereof, and further, a top inner peripheral surface 821*a* of the rising curved part 821 that is provided on an upstream side of the falling curved part 822 is provided as a curve that is sharper than that of the top inner peripheral surface 822*a* of the falling curved part 822 in a side view thereof, so that a washing water W31 is not readily returned to an upstream side thereof.

Furthermore, a pipe diameter of the falling curved part 822 is increased toward a downstream side thereof, so that a backward flow of a washing water W31 that reaches a downstream side of a curved top part of the drainage water trap 8 by collision with the top inner peripheral surface 822*a* of the falling curved part 822 is prevented or reduced, and a washing water W32 is readily guided to the discharge port 9.

Additionally, although the flush toilet 1 (the toilet body 2) is a wall-hung type in an embodiment as described above, this is not limiting, and for example, a floor standing type may be provided. In such a case, the discharge port 9 is arranged, for example, directly below the falling pipe line 83.

Furthermore, although the curved pipe line 82 is a pipe line with a mountain shape that is composed of the rising curved part 821 and the falling curved part 822 in an embodiment as described above, a pipe line may be provided that has the rising curved part 821 and the falling curved part 822 and also has another/other site(s).

An aspect of an embodiment aims to provide a flush toilet that is capable of preventing or reducing a backward flow of a washing water in a curved part of a drainage water trap and is capable of preventing or reducing degradation of a discharge performance.

A flush toilet according to an aspect of an embodiment is a flush toilet that washes a toilet body with a washing water, wherein the toilet body includes a bowl part that receives a waste, a drainage water trap that is connected to a bottom of the bowl part, a jet water spout port that spouts a washing water from a front side of the drainage water trap toward the drainage water trap, and a discharge port that is connected to the drainage water trap and discharges a waste from the toilet body, wherein the drainage water trap includes a rising pipe line that is connected to the bowl part, a curved pipe line that has a rising curved part that is connected to the rising pipe line and rises toward a back side thereof and a falling curved part that falls from the rising curved part toward a back side thereof, and a falling pipe line that is connected to the curved pipe line, wherein the drainage water trap has a swelled part that forms a space that is swelled toward a back side thereof and is continuous with the discharge port, on a downstream side of a curved top part of the curved pipe line.

In such a configuration, a space that is swelled toward a back side thereof is formed in a drainage water trap, so that, when a washing water that is spouted from a jet water spout port reaches a downstream side of a curved top part of the drainage water trap, a reaching washing water flows into a swelled part, that is, the space that is swelled toward a back side thereof. Thereby, it is possible to prevent or reduce a backward flow of a washing water in a curved part (a curved pipe line) of a drainage water trap. Furthermore, a backward flow of a washing water is thus prevented or reduced, so that it is possible to prevent or reduce degradation of a discharge performance.

Furthermore, in the flush toilet as described above, the falling pipe line has a protrusion part that protrudes backward so as to be continuous with the falling curved part and is continuous with the discharge port.

In such a configuration, a curved pipe line to a discharge port are continuous, so that a washing water that flows into a swelled part is guided to the discharge port immediately and a washing water does not stay in the swelled part. Thus, a washing water does not stay in a swelled part, so that it is possible to further prevent or reduce degradation of a discharge performance.

Furthermore, in the flush toilet as described above, the protrusion part protrudes so as to extend from a top inner peripheral surface of the falling curved part toward a back side thereof in a horizontal direction.

In such a configuration, a protrusion part protrudes so as to extend from a curved pipe line in a horizontal direction, so that it is possible to separate a washing water that flows along a top inner peripheral surface of a falling curved part from the top inner peripheral surface, at a position in a drainage water trap where changing from the top inner peripheral surface of the falling curved part to the protrusion part is caused, and transfer it into a space of the protrusion part.

Furthermore, in the flush toilet as described above, the protrusion part is formed on only a back side of the falling pipe line.

In such a configuration, a protrusion part is formed on only a back side of a falling pipe line, in other words, the protrusion part is formed on only a back side part of the falling pipe line, so that a vector of a backward flow is increased and it is possible to enhance a flow of a washing water toward a discharge port.

Furthermore, in the flush toilet as described above, a width of a side of the protrusion part is substantially identical to a width of a side of the rising curved part.

In such a configuration, a width of a side of a protrusion part is substantially identical to a width of a side of a rising curved part, so that it is possible to cause a washing water that flows through the rising curved part to flow into the protrusion part without causing a pressure loss.

Furthermore, in the flush toilet as described above, the curved pipe line is composed of a rising curved part that rises toward a back side thereof and a falling curved part that falls from the rising curved part toward a back side thereof, and a curvature of a top inner peripheral surface of the falling curved part is less than a curvature of a top inner peripheral surface of the rising curved part in a side view thereof.

In such a configuration, a top inner peripheral surface of a falling curved part where a washing water that reaches a downstream side of a curved top part of a drainage water trap collides therewith is provided with a gentle curve in a side view thereof, so that a washing water is readily guided to a back side thereof, and further, a top inner peripheral surface of a rising curved part on an upstream side of the falling curved part is provided with a curve that is sharper than that of the top inner peripheral surface of the falling curved part in a side view thereof, so that a washing water is not readily returned to an upstream side thereof.

Furthermore, in the flush toilet as described above, a distance between an upper end part of a top inner peripheral surface and a lower end part of a bottom inner peripheral surface of the falling curved part on a cross section of a flow path thereof is increased toward a downstream side thereof in a side view thereof.

In such a configuration, a backward flow of a washing water that reaches a downstream side of a curved top part of a drainage water trap that is caused by colliding with a top inner peripheral surface of a falling curved part is prevented or reduced, and a washing water is readily guided to a discharge port.

According to an aspect of an embodiment, it is possible to prevent or reduce a backward flow of a washing water in a curved part of a drainage water trap and it is possible to prevent or reduce degradation of a discharge performance.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet that washes a toilet body with a washing water, wherein the toilet body includes:

a bowl part that receives a waste;

a drainage water trap that is connected to a bottom of the bowl part;

a jet water spout port that spouts a washing water from a front side of the drainage water trap toward the drainage water trap; and a discharge port that is connected to the drainage water trap and discharges a waste from the toilet body, wherein the drainage water trap includes:

a rising pipe line that is connected to the bowl part;

a curved pipe line that includes a rising curved part that is connected to the rising pipe line and rises backward and a falling curved part that falls backward from the rising curved part; and a falling pipe line that is connected to the curved pipe line, wherein the drainage water trap includes a swelled part that forms a space that is swelled backward and is continuous with the discharge port, on a downstream side of a curved top part of the curved pipe line, wherein the curved pipe line is composed of a rising curved part that rises backward and a falling curved part that falls backward from the rising curved part, and a curvature of a top inner peripheral surface of the falling curved part is less than a curvature of a top inner peripheral surface of the rising curved part in a side view thereof.

2. The flush toilet according to claim 1, wherein a pipe diameter of the falling curved part on a cross section perpendicular to a flow path direction is increased toward a downstream side thereof in a side view thereof.

3. The flush toilet according to claim 1, wherein the falling pipe line includes a protrusion part that protrudes backward to be continuous with the falling curved part and is continuous with the discharge port.

4. The flush toilet according to claim 3, wherein the protrusion part protrudes to extend backward from a top inner peripheral surface of the falling curved part in a horizontal direction.

5. The flush toilet according to claim 3, wherein the protrusion part is formed behind the falling pipe line.

6. The flush toilet according to claim 3, wherein a width of the protrusion part in leftward and rightward directions is substantially identical to a width of the rising curved part in leftward and rightward directions.

* * * * *